United States Patent [19]

De Roo et al.

[11] Patent Number: 4,525,445

[45] Date of Patent: Jun. 25, 1985

[54] ELECTROSTATIC TONER COMPRISING THERMOPLASTIC RESIN BINDER FOR NIGROSINE BASE SALT

[75] Inventors: Pierre R. De Roo; Serge M. Tavernier, both of Schoten, Belgium

[73] Assignee: Agfa-Gevaert N.V., Mortsel, Belgium

[21] Appl. No.: 599,164

[22] Filed: Apr. 11, 1984

[30] Foreign Application Priority Data

Apr. 13, 1983 [EP] European Pat. Off. ..... 83200514.4

[51] Int. Cl.[3] ..... G03G 9/10; G03G 9/14; G03G 9/12

[52] U.S. Cl. ..... 430/109; 430/106; 430/107

[58] Field of Search ..... 430/109, 106, 107

[56] References Cited

U.S. PATENT DOCUMENTS

| | | | |
|---|---|---|---|
| 2,618,552 | 11/1952 | Wise | 430/121 |
| 3,647,696 | 3/1972 | Olson | 430/109 |
| 3,985,664 | 10/1976 | Sakaguchi et al. | 430/109 |
| 4,142,982 | 3/1979 | Yamakami et al. | 430/109 |
| 4,271,249 | 6/1981 | Gilliams et al. | 430/106 X |
| 4,331,755 | 5/1982 | Gilliams et al. | 430/106 |

FOREIGN PATENT DOCUMENTS

| | | | |
|---|---|---|---|
| 0010801 | 5/1980 | European Pat. Off. | 430/109 |
| 179862 | 11/1982 | Japan | 430/106 |

*Primary Examiner*—John E. Kittle
*Assistant Examiner*—Mukund J. Shah
*Attorney, Agent, or Firm*—William J. Daniel

[57] ABSTRACT

A particulate composition of matter for magnetic brush development of electrostatic charge patterns, adapted upon mixing with magnetic carrier particles to acquire a net positive charge, which contains colorant material and thermoplastic resin binder, the colorant material comprising a salt formed from a nigrosine base and at least one carboxylic acid containing one or two carboxylic acid groups and having from 2 to 26 carbon atoms, wherein the nigrosine salt is dispersed as particles in the thermoplastic resin binder which contains a polyester derived from fumaric acid or a mixture of at least 95 mol % fumaric acid and the balance isophthalic acid and a polyol blend of propoxylated bisphenol. The charge pattern is developed by contacting the same under the influence of an applied magnetic field with a mixture of magnetic carrier particles and the particulate composition.

10 Claims, No Drawings

ELECTROSTATIC TONER COMPRISING THERMOPLASTIC RESIN BINDER FOR NIGROSINE BASE SALT

The present invention relates to a composition for use in the developing of electrostatic charge patterns.

In electrostatography a latent electrostatic charge image is made visible, i.e. developed, by charged toner particles.

In electrophotography an electrostatic latent charge image is obtained with an electrophotographic material typically comprising a coating of a photoconductive insulating material on a conductive support. This coating is given a uniform surface charge in the dark and is then exposed to an image pattern of activating electromagnetic radiation such as light or X-rays. The charge on the photoconductive element is dissipated in the irradiated area to form an electrostatic charge pattern which is then developed with an electrostatic marking material. The marking material or toner, as it is also called, whether carried in an insulating liquid or in the form of a dry powder deposits on the exposed surface in accordance with either the charge pattern or the discharge pattern as desired. If the photoconductive element is of the reusable type, e.g. a selenium coated drum, the toner image is transferred to another surface such as paper and then fixed to provide a copy of the original.

A variety of electrostatic developers are available for use in developing electrostatic charge patterns. According to a known embodiment the developer comprises carrier particles and electroscopic marking or toner particles electrostatically adhering thereto. The carrier may comprise various materials and as the name implies, serves as a medium for carrying the electrostatically responsive marking particles to the charge pattern to be developed. Among the more common types of carrier-toner developers are dry developers known for use in cascade development as described e.g. in U.S. Pat. No. 2,618,552 and for use in magnetic brush development as described e.g. in U.S. Pat. No. 3,003,462.

The cascade development technique is carried out by rolling or cascading across the electrostatic latent image bearing surface, a developing mixture composed of relatively large carrier particles, each having a number of electrostatically adhering toner particles on its surface. As this mixture rolls across the image-bearing surface, the toner particles are electrostatically deposited on the charged portions of the image.

The magnetic brush development technique involves the use of magnetic means associated with a developing mixture composed of magnetic carrier particles carrying a number of smaller electrostatically adhering toner particles. In this technique the developer composition is maintained during the development cycle in a loose, brushlike orientation by a magnetic field surrounding, for example, a rotatable non-magnetic cylinder having a magnetic means fixedly mounted inside. The magnetic carrier particles are attracted to the cylinder by the described magnetic field, and the toner particles are held to the carrier particles by virtue of their opposite electrostatic polarity. Before and during development, the toner acquires an electrostatic charge of a sign opposite to that of the carrier material due to triboelectric charging derived from their mutual frictional interaction. When this brushlike mass of magnetic carrier with adhering toner particles is drawn across the photoconductive surface bearing the electrostatic image, the toner particles are electrostatically attracted to an oppositely charged latent image and form a visible toner image corresponding to the electrostatic image. Thus, electrophotography is inherently a direct positive process. In some instances, however, photocopying requires the production of positive prints from photographic negatives.

In the production of positive prints from line negatives, negative charges will be induced in the exposed areas in which the surface charge, e.g. positive charge, has leaked off. Such is due to the fringe effect at the surface of the photoconductor coating near the edges of the areas that have lost their positive charges. Now, if the photoconductor coating is developed with an electropositive developer, the positively charged toner will be attracted to the included negative charges, and a photographically positive image is developed. Reversal development of large image area will likewise be possible when applying a bias voltage to a magnetic brush applicator which acting as a development electrode induces when positively charged, through the conductive carrier particles a negative charge in the discharged area of the previously positively charged photoconductor coating (ref. R. M. Schaffert "Electrophotography" The Focal Press—London, New York enlarged and revised edition 1975 p. 50–51 and T. P. Maclean "Electronic Imaging" Academic Press—London, 1979 p.231).

According to the United Kingdom Patent Specification No. 1,253,573 an electrostatic developer particularly useful for magnetic brush development is provided which developer comprises particles of a thermoplastic resin having uniformly dissolved therein a salt formed from nigrosine base and at least one organic acid containing one or two acid groups and having from 2 to 26 carbon atoms.

According to said U.K. Patent Specification it is possible to obtain high charge levels and great uniformity of charge.

Preferably the organic acids are carboxylic acids containing from 2 to 20 carbon atoms. Examples of organic acids useful in the salt formation with the nigrosine base are chloroacetic acid, octanoic acid, oleic acid, lauric acid, stearic acid, docosanoic acid, hexacosanoic acid, sebacic acid, adipic acid, azaleic acid and abietic acid. The nigrosine salts are prepared in a conventional manner by merely mixing nigrosine free base and a substantially neutralizing amount of at least one of these organic acids, at a temperature above the melting points of both ingredients.

Thermoplastic resin useful for dissolving the nigrosine base salt include polystyrene, polyamides and polyester condensates such as poly(ethylene glycol-terephthalate-isophthalate), poly(ethylene glycol-neopentylene glycol terephthalate-isophthalate) and modified alkyd resins e.g. rosin modified maleic alkyd resins.

The above toner particles can be prepared by any conventional technique such as spray drying a solution in a suitable volatile solvent or grinding a solidified composition prepared by thorough mixing of the melting components to cause complete solution.

It is an object of the present invention to provide toner particles that can acquire a positive charge by frictional contact with carrier particles.

It is another object of the present invention to provide a toner-carrier composition for use in reversal development with a magnetic brush.

It is still another object of the present invention to provide toner particles that can be rapidly and efficiently fixed by flash-fusing and/or infra-red radiation fixing at a relatively low energy level.

Other objects and advantages of the present invention will become clear from the further description.

In accordance with the present invention there is provided a composition of matter for use in the developing of electrostatic charge patterns, which composition is in the form of toner particles that are capable of acquiring by mixing with carrier particles a net positive charge and contain thermoplastic resin as binder for a salt formed from nigrosine base (C.I. 50415B) and at least one carboxylic acid containing one or two carboxylic acid groups and having from 2 to 26 carbon atoms, characterized in that (1) the thermoplastic resin binder in the toner particles contains at least 75% by weight of a polyester derived from fumaric acid or a mixture of fumaric acid and isophthalic acid wherein the fumaric acid represents at least 95 mole % of the acids and a polyol blend of propoxylated bisphenol characterized by the formula:

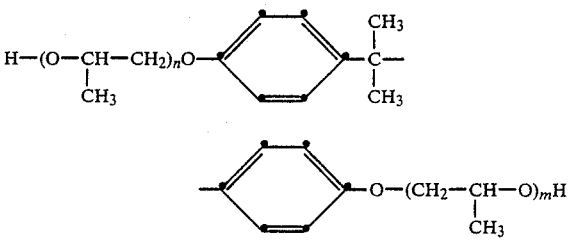

wherein m and n are integers with the proviso that the average sum of m and n is from 2 to 7, the polyester resin being obtained from an amount of acid to polyol so that the number of carboxyl groups to hydroxyl groups is in the ratio of 1.2:1 to 0.8:1, said polyester having a melting point in the range of 60°-90° C., preferably 65°-85° C., (2) the salt formed from the nigrosine base and at least one organic acid containing one or two acid groups and having from 2 to 26 carbon atoms has a melting point higher than the melting temperature of the resin binder and is dispersed therein binder in a weight ratio of not more than 10% and within a particle size range of 0.1 to 10 μm, preferably in the range of 0.2 to 3 μm, and (3) the toner particles have a particle size in the range of 3 to 30 μm, preferably in the range of 5 to 20 μm.

The present invention includes a method of forming toner particles comprising the steps:

(1) melting the thermoplastic resin having a melting point lower than the nigrosine salt, (2) dispersing the nigrosine salt in the molten resin without melting the nigrosine salt to obtain dispersed particles of salt in a particle size range of 0.1 to 10 μm.

(3) solidifying the melt.

(4) bringing the solidified melt in particulate form e.g. by grinding, (5) separating e.g. by air sifter from the solidified particulate mass the toner particles having a size in the range of 3 to 30 μm.

It has been established experimentally (see Example 2 and Table 2) that the dissolving (molecular distribution) of the nigrosine salt at a weight ratio of not more than 10% in the above polyester resin of fumaric acid rather than dispersing it therein yields toners with negative charge sign when mixed with the same magnetically attractable iron-bead carrier particles.

So, it is fairly surprising that the "colloidal" structure of the nigrosine salt in the polyester resin binder offers a positively charged toner. This means that it is possible to influence the charge level towards a more positive charge by the fact of dispersing the charge controlling agent (the nigrosine salt) rather than by dissolving it.

Further it has been established experimentally (see Example 3) that the dispersion of free nigrosine base in the present polyester resin binder yields a toner with negative charge sign, so that for obtaining a high positive charge level preferably no free nigrosin base is present.

According to a preferred embodiment the above polyester resin is used in admixture with other thermoplastic resin(s) that increase(s) the hardness of the toner without impairing or only slightly reducing its positive chargeability. A harder toner is in favour of a longer developer lifetime because "smearing" of the toner particles on the carrier particles becomes less.

Thermoplastic resins having a melting point in the range of 100° to 120° C. and containing in their structure a major part by weight of aromatic groups, e.g. phenyl groups, and a minor part by weight of electron donating groups, e.g. alkylamino or arylamino groups are suited for that purpose. Thermoplastic resins particularly suited therefor are copolymers containing at least 75% of styrene monomer units and up to 25% by weight of monomer units including a dialkylamino group.

Preferred copolymers of that type have the following structural formula (A):

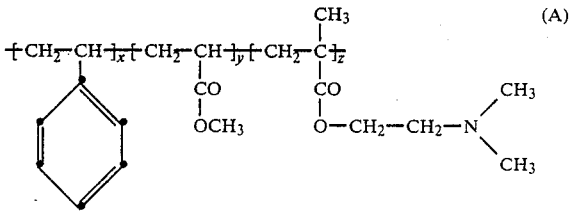

(A)

wherein:

x is 83-87% by weight y is 0-4% by weight z is 13-17% by weight, and have a melting point (ring and ball method) in the range of 106° to 115° C. The copolymer is preferably present in a weight ratio range of 5 to 25% with respect to the total binder content.

The copolymer is prepared by common addition polymerisation starting with the monomers involved.

In the preparation of the present polyester resin the propoxylated bisphenol has in the above mentioned structural formula an average sum of n and m from 2 to 7 which means that in the polyol blend some of the propoxylated bisphenols within the above formula may have more than 7 repeating oxypropylene units but that the average value of the number of oxypropylene units in the polyol blend is from 2 to 7 per bisphenol unit. In a preferred embodiment the propoxylated bisphenol is obtained from 2 to 3 moles of propylene oxide per mole of 2,2-bis(4-hydroxyphenyl)propane.

The polyol blend used in the preparation of the polyester binder may be prepared by bringing propylene oxide in contact with 2,2-bis(4-hydroxyphenyl)propane also called "Bisphenol A".

The preparation of the above polyester resins and the use of said polyesters in the manufacture of xerographic toners has been described in United Kingdom Patent Specification No. 1,373,220.

The polyester preparation is preferably performed in an inert atmosphere, e.g. under carbon dioxide, at a moderate temperature and substantially atmospheric pressure during the early stage to reduce loss of the unsaturated acid by volatilization. As the reaction proceeds the temperature may be increased and the pressure reduced. An esterification catalyst may be used although it is generally preferred to carry out the reaction in the absence of excessive amounts of catalyst. A suitable amount of polymerization inhibitor such as hydroquinone or pyrogallol is used to suppress the polymerization through the double bond of the fumaric acid.

The procedure employed to prepare the polyesters useful in this invention generally includes heating to about 200° C. for a period of time sufficient to obtain a desired degree of esterification. The resulting polyester preferably has a low acid number i.e. of not more than 20. The acid number of a resin is determined by measuring the number of miligrams of potassium hydroxide required to neutralize 1 gram of resin. In preparing the polyester, the ratio of carboxyl groups to hydroxyl groups of the starting materials is preferably about 1:1.

A propoxylated bisphenol A fumarate polyester particularly suitable for use according to the present invention is ATLAC T500, trade name of Atlas Chemical Industries Inc. (Wilmington, Del., U.S.).

This polyester has a glass transition temperature of 51° C. and melts in the range of 65° to 85° C. The acid number of said polyester is 13.9. Its intrinsic viscosity [$\eta$] measured at 25° C. in a mixture of phenol/orthodichlorobenzene (60/40 by weight) is 0.175.

The nigrosine base used in the preparation of the nigrosine salt is known as C.I. Solvent Black 7, The Colour Index number being C.I. 50415 B. The nigrosine base is prepared by (a) heating nitrobenzene, aniline, and aniline hydrochloride with iron or copper at 180°-200° C. or (b) heating nitrophenol or the nitrocresols, aniline, and aniline hydrochloride with a little iron at 180°-200° C. More details about the preparation can be found in e.g. French Patent Specification No. 77854; BIOS 959,10; BIOS 1433,82,93,104; FIAT 764—Nigrosin NBV, T, TA, Base; Wolff, Chem. News, 39 (1879), 270; O. Fischer & Hepp, Ber. 23 (1890), 2789; 28 (1895), 293; 29 (1896), 361, 367. Kehrmann, Ber. 27 (1894), 3348; 28 (1895), 1543. Kehrmann & Guggenheim, Ber. 34 (1901), 1217, Nietzki & Slaboszewicz, Ber. 34 (1901), 3727, Wilberg, Ber. 35 (1902), 958, Nietzki & Vollenbruck, Ber. 37 (1904), 3887.

The nigrosine salts for use according to the present invention are prepared by merely mixing the nigrosine base with a neutralizing amount of the carboxylic acid or with an excess of carboxylic acid wherein the excess may be in an amount up to the amount necessary to neutralize the base. Preferably a fatty acid such as stearic acid is used.

The toner particles of the present developer composition preferably have a melting point in the range of 70° to 90° C. more preferably 80° C.

In order to obtain optimal results with regard to charge level and toner hardness the weight ratio of the nigrosine salt with respect to the polyester resin is preferably in the range of 3 to 8% by weight.

Since the nigrosine salt itself has a dark blue to black colour it is not strictly necessary to add a further colorant such as a colour-balancing dye. Preferably, however, the colour toner is made more deeply black by adding carbon black to the toner composition.

Examples of carbon black and analogous forms therefor are lamp black, channel black, and furnace black e.g. SPEZIALSCHWARZ IV (trade-name of Degussa Frankfurt/M, W. Germany) and VULCAN XC 72 and CABOT REGAL 400 (trade-names of Cabot Corp. High Street 125, Boston, U.S.).

The characteristics of preferred carbon blacks are listed in the following table 1.

TABLE 1

| | SPEZIALSCHWARZ IV | CABOT REGAL 400 |
|---|---|---|
| origin | channel black | furnace black |
| density | 1.8 g × $cm^{-3}$ | 1.8 g × $cm^{-3}$ |
| grain size before entering the toner | 25 nm | 25 nm |
| oil number (g of linseed oil adsorbed by 100 g of pigment) | 300 | 70 |
| specific surface (sq.m per g) | 120 | 96 |
| volatile material (% by weight) | 12 | 2.5 |
| pH | 3 | 4.5 |
| colour | brown-black | black |

In the preparation of the toner the carbon black is added to the mixture of molten polyester and non-molten nigrosine salt, optionally in admixture with the resin for improving the hardness, while stirring until a mixture of homogeneously dispersed carbon black and dispersed nigrosine salt in the polyester resin melt is obtained. The optimal mixing temperature determined by experiments proved to be in the range of 80° to 110° C., so that the above defined copolymer (A) for improving the hardness is present, at least partly, in dispersed form.

After cooling, the solid mass obtained is crushed and ground e.g. in a hammer mill followed by a jet-mill to an average particle size of 1 to 50 microns. The fraction having a particle size between 3-30 $\mu$m separated e.g. by air sifter is used. The resulting powder is not tacky below 50° C.

The carbon black is normally used in an amount of 3 to 10% preferably 5% by weight calculated on the total weight of toner.

For a given charge density of the charge-carrying surface the maximum development density attainable with toner particles of a given size is determined by the charge/toner particle mass ratio, which is determined substantially by the triboelectric charge obtained by friction-contact with the carrier particles.

The toner according to the present invention is applied preferably in carrier-toner mixtures wherein the toner acquires a positive charge by frictional contact with the carrier. The carrier-toner mixture is preferably applied to the surface carrying a latent electrostatic image by cascade-, or magnetic brush development which techniques are described in detail by Thomas L. Thourson in his article "Xerographic Development Processes: A Review", IEEE Transactions on Electron Devices, Vol. ED-19, No. 4, April 1972 p. 497-504.

Suitable carrier particles for use in cascade and for magnetic brush development are described in the United Kingdom Patent Specification No. 1,438,110.

The carrier particles are preferably at least 3 times larger in size than the toner particles and more preferably have an average grain size in the range of 50 to 1000 microns. Preferably glass beads having a diameter of 600 to 800 microns or iron or steel beads of 300 to 600 microns are used. The developer composition may for example contain 1 to 5 parts by weight of toner particles per 100 parts by weight of carrier particles. The glass and iron or steel beads may be subjected to special pretreatments to enhance the triboelectric charging of the toner. Suitable coating-treatments of carrier beads are described e.g. in said last mentioned U.K. Patent Specification.

In magnetic brush development the carrier particles are magnetically attractable. According to U.S. Pat. No. 2,786,440 iron particles that have been washed free from grease and other impurities and having a diameter of $1.52\times10^{-1}$ to $2.03\times10^{-1}$ mm are used as magnetic carrier particles.

In a preferred embodiment of the present invention iron carrier beads of a diameter in the range of 50 to 200 microns having a thin iron oxide skin are used. These carrier beads have almost a spherical shape and are prepared e.g. by a process as described in United Kingdom Patent Specification No. 1,174,571.

Before being mixed with the toner particles a thin layer of the nigrosine salt may be applied to the surface of the carrier particles by contacting their surface with an organic solution of the nigrosine salt and removing the solvent by evaporation. The nigrosine salt is preferably added in an amount of 0.05 to 0.02 g with respect to 100 g of carrier beads. Such precoating offers carrier-toner compositions that have a reproducible charge level already from the first developed electrostatic images on. In this connection it has been established experimentally that the dispersed nigrosine salt of the toner transfers during frictional contact from the toner to the carrier and gradually smears out thereon. The surface structure of the toner particles shows micro-area of nigrosine salt in a matrix of the polyester resin.

On using the above-mentioned copolymer having structural formula (A) the pre-coating of the carrier particles with nigrosine salt can be omitted and yet from the first developed images on a reproducible charge level on the toner particles is obtained.

In order to improve the flowing properties of the developer the toner particles are mixed with a flow improving means such as colloidal silica particles and/or microbeads of a fluorinated polymer. The flow improving means is used e.g. in an amount of 0.05 to 1% by weight with respect to the toner.

Colloidal silica has been described for that purpose in the United Kingdom Patent Specification No. 1,438,110 e.g. AEROSIL 300 (trade mark of Degussa, Frankfurt (M) W. Germany for colloidal silica having a specific surface area of 300 sq.m/g. The specific surface area can be measured by a method described by Nelsen and Eggertsen in "Determination of Surface Area Adsorption Measurements by Continuous Flow Method", Analytical Chemistry, Vol. 30, No. 8 (1958) 1387–1390.

Suitable fluorinated polymer beads for improving the flowing properties of the toner as well as of the carrier particles are described in the U.S. Pat. No. 4,187,329. A preferred fluorinated polymer for said use is poly(tetrafluoroethylene) having a particle size of 3 to 4 μm and melting point of 325°–329° C. Such poly(tetrafluoroethylene) is sold under the trade name HOSTAFLON TF-VP-9202 by Farbwerke Hoechst A.G. W. Germany.

An other fluorinated polymer useful for that purpose is polyvinylidene fluoride having an average particle size of 5 μm sold under the trade name KYNAR RESIN 301 by Pennwalt Corp.-Plastic div. England.

The colloidal silica and at least one of the fluorinated polymers are preferably mixed with the toner in a proportion of 0.15% to 0.075% by weight respectively. The toner becomes thereby non-tacky and obtains a reduced tendency to form a film on the xerographic plates or drums e.g. having a vapour-deposited coating of a photoconductive Se-As alloy on a conductive substrate e.g. aluminium.

In order to obtain toner particles having magnetic properties a magnetic or magnetizable material may be added during the toner production.

Magnetic materials suitable for this purpose are magnetic or magnetizable metals including iron, cobalt, nickel and various magnetizable oxides including $Fe_2O_3$, $Fe_3O_4$, $CrO_2$, certain ferrites derived from zinc, cadmium, barium and manganese. Likewise may be used various magnetic alloys, e.g. permalloys and alloys of cobalt-phosphors, cobalt-nickel and the like or mixtures of any of these. Good results can be obtained with about 30% to about 80% by weight of magnetic material with respect to the resin binder.

The following examples illustrate the present invention without, however, limiting it thereto. All parts, ratios and percentages are by weight unless otherwise stated.

EXAMPLE 1

90 parts of ATLAC T500 (trade name), 5 parts of carbon black (Spezialschwarz IV—trade name) and 5 parts of a nigrosine base neutralized with stearic acid were mixed in a heated kneader. The melting range of ATLAC T500 (trade name) was 65°–85° C. The melting range of the nigrosine base stearic acid salt was 110°–120° C. The mixing proceeded for 15 minutes at a temperature of the melt corresponding with 105° C. Thereafter the kneading was stopped and the mixture was allowed to cool to room temperature (20° C.). At that temperature the mixture was crushed and milled to form a powder. From the obtained powder, the particles with a size between 3 and 30 μm were separated to form the toner.

In order to visualize the fact that the nigrosine base salt was dispersed in the polyester binder and not dissolved, toner particles were cut in slices of a thickness of 1 μm with a microtome. The thus obtained slices were put under a microscope with a 1000× magnifying power. At that magnifying power the carbon black particles are not individually identifyable which was confirmed by a test without nigrosine salt but the latter salt appeared in the polymer matrix as dark spots the diameter of which was 0.5 to 2 μm.

EXAMPLE 2

Example 1 was repeated with the difference however, that the temperature of the melt in the kneader was held at 130° C.

EXAMPLE 3

Example 1 was repeated with the difference, however, that 5 parts of the nigrosine salt were replaced by 5 parts of the free nigrosine base.

EXAMPLE 4

Example 1 was repeated with the difference that the weight ratio of the three components in the toner was: 88 parts of ATLAC T500, 5 parts of carbon black and 7 parts of the nigrosine salt.

EXAMPLE 5

Example 1 was repeated with the difference that the weight ratio of the three components in the toner was: 88 parts of ATLAC T500, 5 parts of carbon black and 3 parts of the nigrosine salt.

EXAMPLE 6

82 parts of ATLAC T500 (trade name), 5 parts of carbon black (Spezialschwarz IV—trade name), and 3 parts of a nigrosine base neutralized with stearic acid and containing 24% by weight of non-neutralized stearic acid in excess and 10 parts of copoly(styrene/methylacrylate/dimethylaminoethylmethacrylate) (83/14/3 by weight) (melting range 106°–115° C.) were mixed in a heated kneader. The melting range of ATLAC T500 (trade name) was 65°–85° C. The melting range of the nigrosine base stearic acid salt was 110°–120° C. The mixing proceeded for 15 minutes at a temperature of the melt corresponding with 105° C. Thereafter the kneading was stopped and the mixture was allowed to cool to room temperature (20° C.). At that temperature the mixture was crushed and milled to form a powder. From the obtained powder, the particles with a size between 3 and 30 μm were separated to form the toner.

In order to visualize the fact that the nigrosine base salt was dispersed in the polyester binder and not dissolved, toner particles were cut in slices of a thickness of 1 μm with a microtone. The obtained slices were put under a microscope with a 1000× magnifying power. At that magnifying power the carbon black particles are not individually identifyable which was confirmed by a test without nigrosine salt but the latter salt appeared in the polyer matrix as dark spots the diameter of which was 0.5 to 2 μm.

In order to evaluate the charge to mass ratio of the toner compositions mentioned in Examples 1 to 6, the toners were mixed with iron carrier beads of a diameter of 65 microns having a thin iron oxide skin. The ratio was 4 parts of toner to 100 parts of carrier. The charge to mass ratio (Q/m) was measured in a blow-off type powder charge measuring apparatus. The results are mentioned in table 2.

TABLE 2

| (Q/M) expressed in micro Coulomb per gram | |
|---|---|
| Example | (μC/g) |
| 1 | +9.8 |
| 2 | −2.1 |
| 3 | −0.7 |
| 4 | +8.1 |
| 5 | +8.4 |
| 6 | +9.6 |

EXAMPLE 7

To 100 parts of the toner of Example 1 were added and mixed therewith 0.15 parts of AEROSIL 300 (trade name) and 0.075 parts of KYNAR Resin 301 (trade name). This toner was mixed with iron carrier beads of a diameter of 70 microns having a thin iron oxide skin. The ratio toner to carrier was 4.5 to 100. A positive toner charge was obtained. The developer mixture yielded in magnetic brush reversal development on a Se-As alloy photoconductor layer a good copy quality without filming.

EXAMPLE 8

To 100 parts of the toner of Example 1 were mixed 0.15 parts of AEROSIL 300 (trade name) and 0.15 parts of HOSTAFLON TF-VP-9292 (trade name). The toner with these flow improving additives was admixed in a ratio of 5 to 100, with an iron bead carrier of a diameter of 70 microns having a thin iron oxide skin and being coated with a thin layer of the nigrosine salt of Example 1. The layer was applied in a fluidised bed reactor in a ratio of 0.1 g of nigrosine salt for 1000 g of iron beads.

A positive toner charge was obtained. The developer mixture yielded in magnetic brush development a good copy quality for a large number of copies.

In a GEVAFAX X-12 (trade name of Agfa-Gevaert N.V. Belgium for a xerographic copying apparatus operating with an infra-red light fusing system), the fixing energy for the above toner was 550 W (input energy of the infra-red lamp), whereas a positive toner containing the nigrosine salt dissolved in a copolymer containing 55% of styrene and 35% of n-butyl methacrylate melting in the range of 78°–102° C. (nigrosine salt/resin ratio: 5/95) needed a fixing energy of 800 W.

We claim:

1. A particulate composition of matter for magnetic brush development of electrostatic charge patterns that is capable of acquiring a net positive charge by mixing with magnetic carrier particles and consists essentially of colorant material and thermoplastic resin binder, said colorant comprising a salt formed from nigrosine base (C.I. 50415B) and at least one carboxylic acid containing one or two carboxylic acid groups and having from 2 to 26 carbon atoms, wherein:

(1) said thermoplastic resin binder includes at least 75% by weight of a polyester derived from fumaric acid or a mixture of fumaric acid and isophthalic acid containing at least 95 mole % of fumaric acid and a polyol blend of propoxylated bisphenol characterized by the formula:

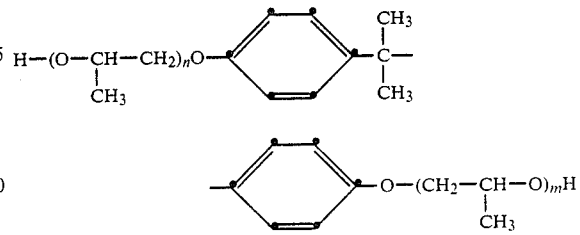

wherein m and n are integers with the proviso that the average sum of m and n is from 2 to 7, said polyester resin being obtained from amounts of acid to polyol such that the ratio of carboxyl groups of said acid to hydroxyl groups of said polyol is in the range of 1.2:1 to 0.8:1 and having a melting point in the range of 60°-90° C., (2) said nigrosine base salt has a melting point higher than the melting temperature of the resin binder and is dispersed in said resin binder in a weight ratio of not more than 10% in the form of particles having a particle size range of 0.1 to 10 μm, and (3) the particle size of the composition is in the range of 3 to 30 μm.

2. The composition of claim 1, wherein the dispersed nigrosine salt particles have a particle size in the range of 0.2 to 3 μm.

3. The composition according to claim 1, wherein said polyester is a propoxylated bisphenol A fumarate polyester melting in the range of 65° to 85° C.

4. The composition according to claim 1, wherein said carboxylic acid is a fatty acid.

5. The composition according to claim 4, wherein said fatty acid is stearic acid.

6. The composition according to claim 1, wherein the particulate composition is mixed with magnetically attractable carrier particles that are at least 3 times larger in size and by means of which on frictional contact the composition particles acquire a net positive charge.

7. The composition according to claim 1, wherein the polyester is present in admixture with a copolymer increasing the hardness of its particles and containing at least 75% by weight of styrene monomer units and up to 25% by weight of monomer units including an alkylamino or arylamino group.

8. The composition according to claim 7, wherein said copolymer is copoly(styrene/methacrylate/dimethylaminoethyl methacrylate) (83/14/3% by weight) being present in a weight ratio range of 5 to 25% with respect to the total resin content.

9. A method for the magnetic brush development of an electrostatic charge pattern which comprises the step of contacting said charge pattern under the influence of an applied magnetic field with a mixture of magnetic carrier particles and said particulate composition according to claim 1.

10. The method of claim 9, wherein said mixture comprises about 1-5 parts by weight of said particulate composition per 100 parts by weight of said carrier particles.

* * * * *